US006553619B2

(12) United States Patent
Chen

(10) Patent No.: US 6,553,619 B2
(45) Date of Patent: Apr. 29, 2003

(54) HANDLE HAVING A COMFORTABLE GRASPING STRUCTURE

(76) Inventor: Wei Chih Chen, No. 59, Herng Jun Street, Da Gia Town, Taichung Hsien (TW), 437

( * ) Notice: Subject to any disclaimer, the term of this patent is extended or adjusted under 35 U.S.C. 154(b) by 0 days.

(21) Appl. No.: 09/943,292

(22) Filed: Aug. 31, 2001

(65) Prior Publication Data

US 2003/0041411 A1 Mar. 6, 2003

(51) Int. Cl.[7] ..... A45F 5/10

(52) U.S. Cl. ..... 16/114.1; 16/430; 16/431; 16/444; 16/DIG. 40

(58) Field of Search ..... 16/114.1, 431, 16/444, 430, 435, DIG. 40, DIG. 41; 190/115

(56) References Cited

U.S. PATENT DOCUMENTS

| | | | | | |
|---|---|---|---|---|---|
| 314,724 | A | * | 3/1885 | Romer | 16/114.1 |
| 1,125,280 | A | * | 1/1915 | Felsberg | 16/114.1 |
| 1,223,504 | A | * | 4/1917 | Markowitz | 16/114.1 |
| 1,909,392 | A | * | 5/1933 | Chesnut | 16/114.1 |
| 2,195,028 | A | | 3/1940 | Finkelstein | |
| 2,918,998 | A | * | 12/1959 | Novelo | 16/114.1 |
| 3,023,868 | A | * | 3/1962 | Koffler | 16/114.1 |
| 3,039,506 | A | * | 6/1962 | Reiter | 150/110 |
| 3,110,377 | A | * | 11/1963 | Eisenmann | 16/445 |
| 3,115,227 | A | * | 12/1963 | Shanok et al. | 16/114.1 |
| 3,301,294 | A | * | 1/1967 | Reiter | 150/107 |
| 3,656,594 | A | * | 4/1972 | Marks et al. | 16/408 |
| 3,736,621 | A | * | 6/1973 | Szabo | 16/435 |
| 3,795,941 | A | | 3/1974 | Szabo et al. | 16/115 |
| 3,813,729 | A | * | 6/1974 | Szabo et al. | 16/114.1 |
| 4,016,315 | A | * | 4/1977 | Szabo | 156/273.9 |
| 4,047,263 | A | * | 9/1977 | Tietze | 16/444 |
| 4,134,480 | A | * | 1/1979 | Davis | 16/405 |
| 4,696,077 | A | * | 9/1987 | Kim | 150/110 |
| 4,782,556 | A | * | 11/1988 | Kim | 150/110 |
| 4,971,645 | A | * | 11/1990 | Licus | 156/213 |
| 5,560,083 | A | * | 10/1996 | Teixeira | 16/411 |

FOREIGN PATENT DOCUMENTS

| | | | | |
|---|---|---|---|---|
| DE | 2828705 | A1 | * | 1/1980 |
| DE | 30471987 | A | * | 7/1982 |

* cited by examiner

*Primary Examiner*—Chuck Y. Mah
(74) *Attorney, Agent, or Firm*—Charles E. Baxley

(57) ABSTRACT

A handle includes an elongate member having two ends coupled to two links with two anchor straps, a covering member engaged around the elongate member and having two end ears engaged over the anchor straps and secured to the anchor straps with fasteners. A cushioning member is engaged between the elongate member and the covering member for forming a comfortable grasping structure. The fasteners may also be engaged through the cushioning member for further solidly securing the covering member and the cushioning member together.

11 Claims, 5 Drawing Sheets

HANDLE HAVING A COMFORTABLE GRASPING STRUCTURE

BACKGROUND OF THE INVENTION

1. Field of the Invention

The present invention relates to a handle, and more particularly to a handle having a structure for allowing the user to grasp with more comfortableness.

2. Description of the Prior Art

Typical handles for such as the suitcases, comprise a circular elongate member having two ends secured or coupled to the typical luggage connecting loops or links. U.S. Pat. No. 2,195,028 to Finkelstein discloses one of the typical handles. The users may not feel comfortable when the luggage device or the suitcase is heavy.

In order to solve the grasping problem, some of the typical handles provide a foam finger grip attached to the handle. U.S. Pat. No. 3,795,941 to Szabo et al., discloses one of the typical handles having a closed-cell foam finger grip attached to the bottom of a solid rigid palm engaging member. However, the solid right palm engaging member is exposed and is secured on the foam finger grip, such that the users also may not feel comfortable to carry the heavy suitcase with the typical handles. In addition, the solid right palm engaging member may be easily disengaged from the foam finger grip after use.

The present invention has arisen to mitigate and/or obviate the afore-described disadvantages of the conventional handles.

SUMMARY OF THE INVENTION

The primary objective of the present invention is to provide a handle including a structure for allowing the user to grasp with more comfortableness.

In accordance with one aspect of the invention, there is provided a handle comprising an elongate body member including two ends, two links, two anchor straps engaged on the ends of the elongate body member and coupled to the links respectively, a covering member engaged around the elongate body member, and including two end ears engaged over the anchor straps, means for fastening the end ears and the covering member and the anchor straps and the ends of the elongate body member together, and a cushioning member engaged around the elongate body member and engaged between the elongate body member and the covering member for providing a comfortable grasping structure. The users may thus grasp the handle to carry the heavy suitcases with a suitable or increased comfortableness.

The elongate body member includes at least one ridge extended therefrom for forming a spatial configuration to the body member.

The anchor straps each includes a curved member engaged over the links respectively, and two panels engaged on the ends of the elongate body member for being secured to the elongate body member with the fasteners.

The covering member includes two flaps engaged around the cushioning member and the elongate body member, and the free edges of the flaps may be secured together with adhesive materials, stitches or by welding processes, or the like.

The fastening means includes two fasteners engaged through the end ears and the covering member and engaged through the anchor straps and engaged through the ends of the elongate body member, for solidly securing the end ears and the covering member and the anchor straps and the ends of the elongate body member together.

Alternatively or simultaneously, the fasteners may be engaged through the end ears of the covering member and engaged through the cushioning member for solidly securing the covering member and the cushioning member together.

A wrapping member may further be provided and engaged around the cushioning member before the covering member is engaged around the cushioning member, and for further solidly retaining the cushioning member within the covering member and for allowing the cushioning member to be easily engaged into the covering member.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
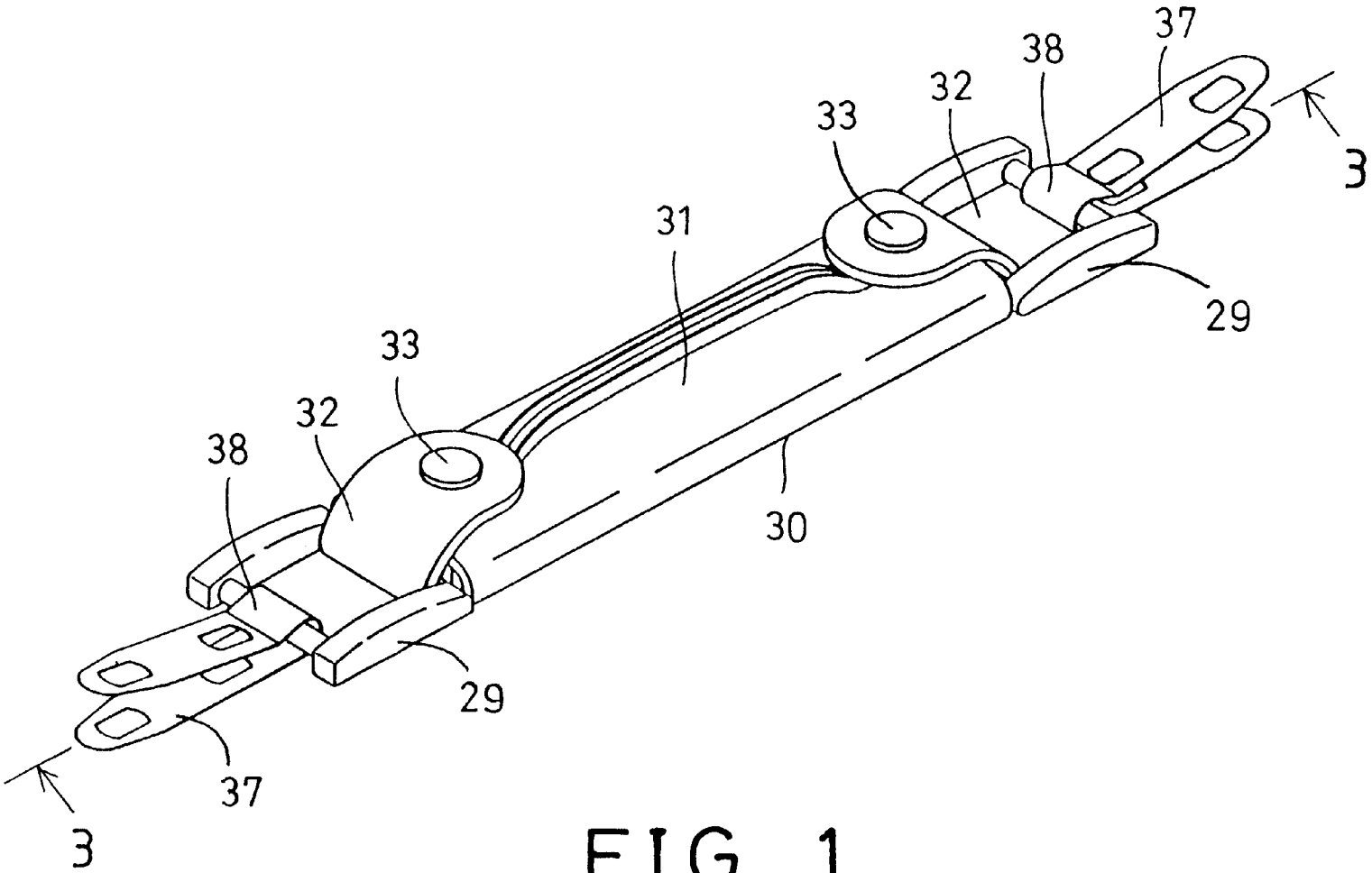
FIG. 1 is a perspective view of a handle in accordance with the present invention.
Figure 2:
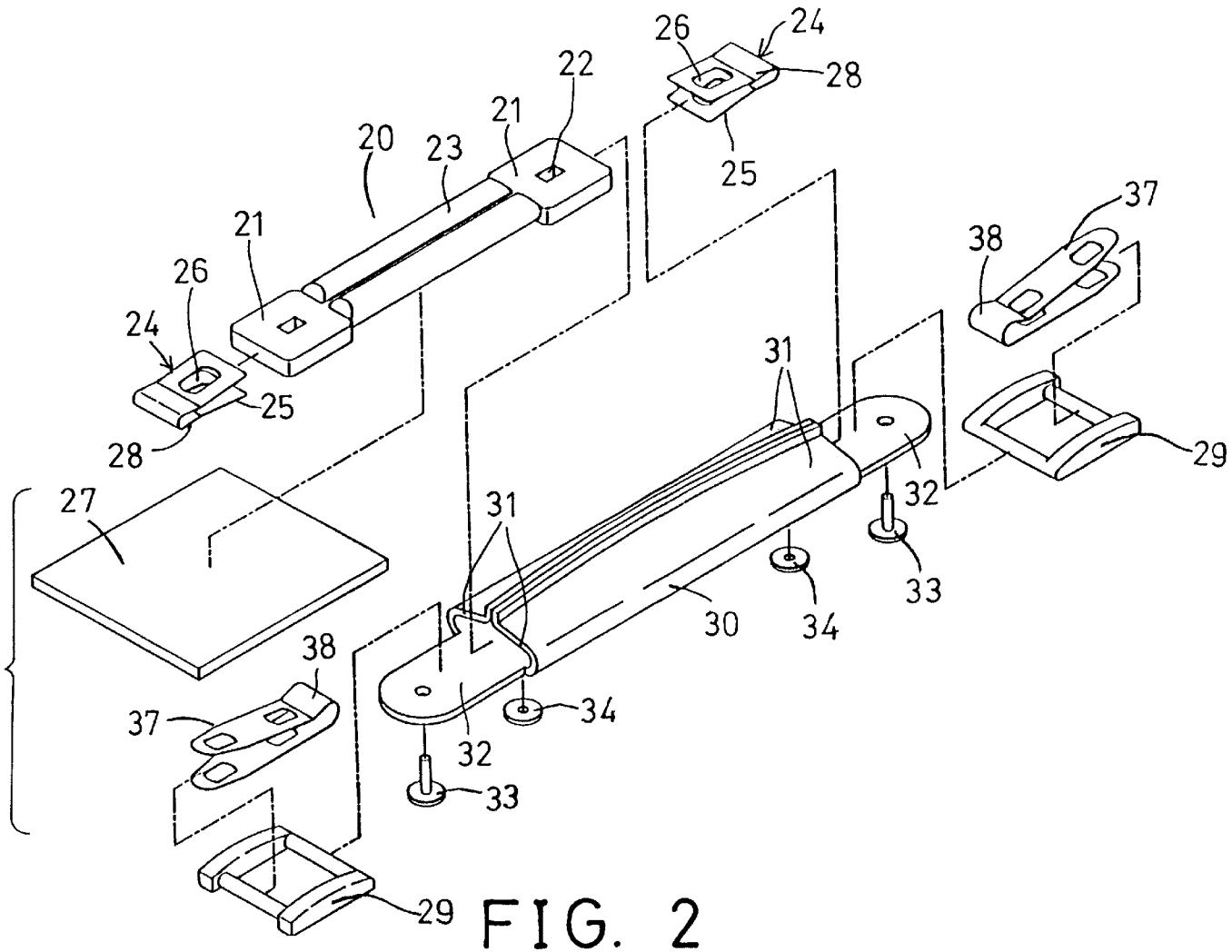
FIG. 2 is an exploded view of the handle.
Figure 3:
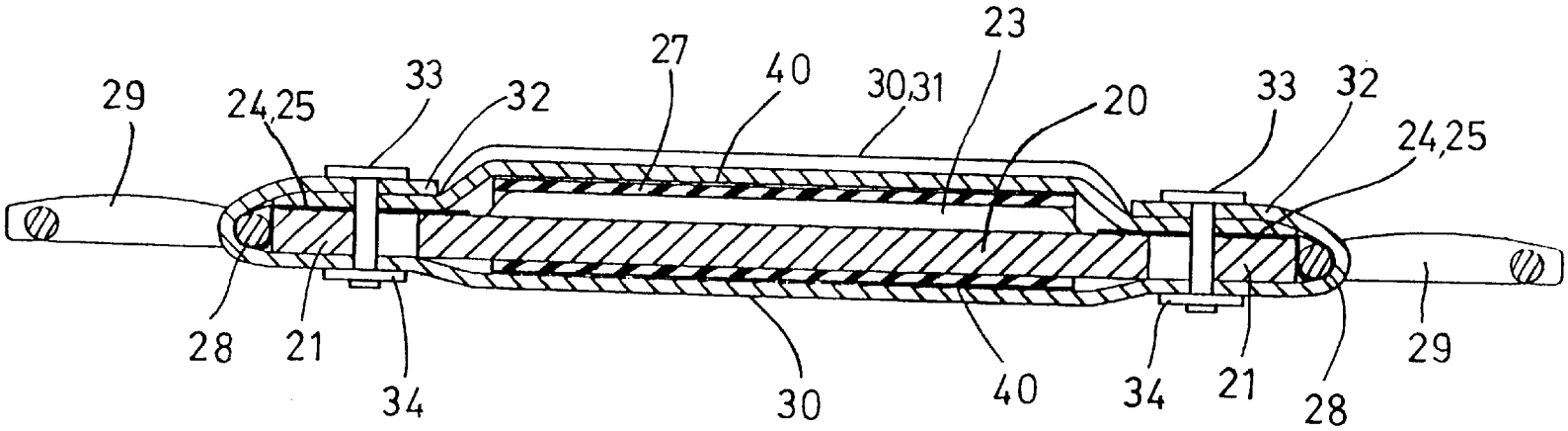
FIG. 3 is a cross sectional view taken along lines 3—3 of FIG. 1.
Figure 5:
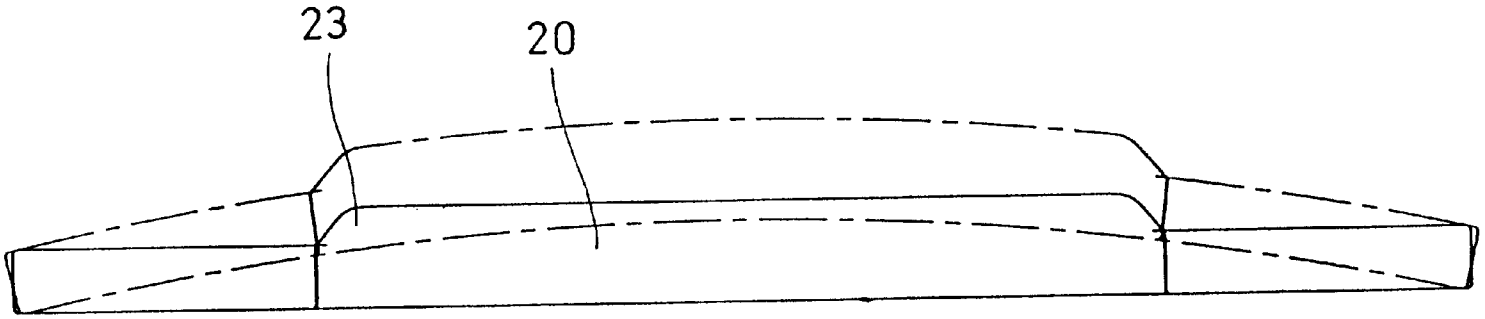
FIG. 5 is a plan view showing the flexibility of the body member of the handle.

Referring to the drawings, and initially to FIGS. 1–3, a handle in accordance with the present invention comprises an elongate body member 20 including a substantially longitudinal flat structure having two flat ends 21 and having an orifice 22 formed in each of the ends 21 thereof. The elongate body member 20 is preferably made of rigid material and injection molded of such as the polypropylene, high density polyethylene, rigid vinyl, polystyrene, acrylonitrile-butadiene-styrene copolymers, and the like, and includes a suitable resilience or flexibility as shown in FIG. 5, and includes one or more bulges or ribs or ridges 23 extended upward and/or downward therefrom for forming a spatial or preferably rounded structure.

Figure 4:
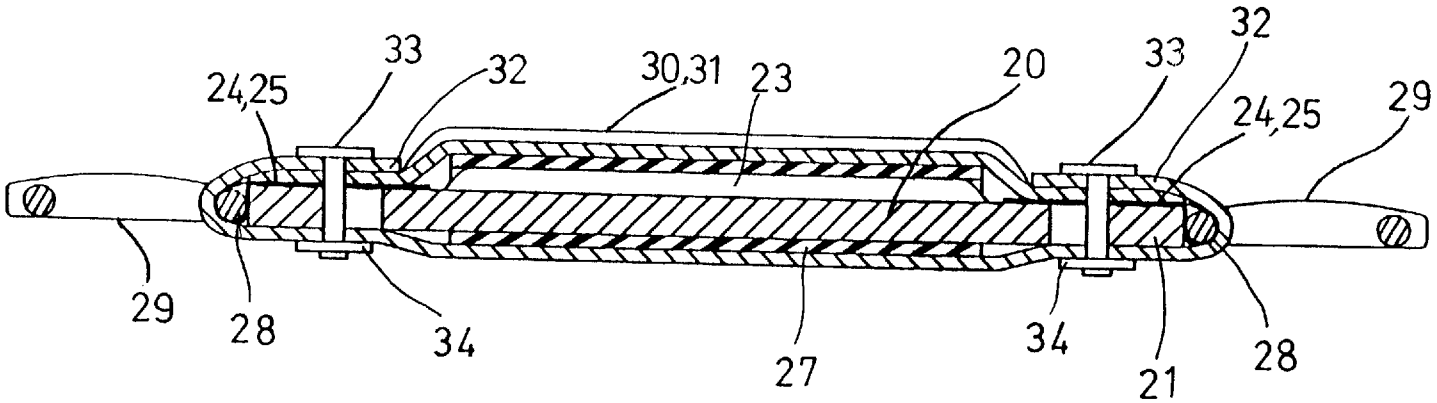
FIG. 4 is a cross sectional view similar to FIG. 3, illustrating the other arrangement of the handle.

Two anchor straps 24 each includes two panels 25 for engaging with the flat ends 21 of the elongate body member 20, and each includes a curved member 28 for engaging over a substantially rectangular chain type link 29 respectively. The panels 25 each includes an aperture 26 formed therein for aligning with the orifices 22 of the flat ends 21 of the elongate body member 20, and for receiving fasteners 33 respectively. A soft or resilient cushioning member 27 is engaged around the elongate body member 20, such as engaged around the ridges 23 of the body member 20 (FIGS. 3, 4). The cushioning member 27 may be made of spongy materials, polyurethane, ethylene-vinyl acetate copolymer, or the like, and may be secured onto the elongate body member 20 with adhesive materials or the like.

A covering member 30 includes two flaps 31 engaged around the cushioning member 27 and the elongate body member 20. The free edges of the flaps 31 may be secured together with such as the adhesive materials, stitches, or by welding processes, or the like, for solidly retaining the cushioning member 27 within the covering member 30. The covering member 30 includes two end ears 32 extended therefrom and engaged around the rectangular chain type links 29 respectively and engaged over the curved members 28 of the anchor straps 24. The fasteners 33 may be engaged through the ears 32 and the apertures 26 of the panels 25 and the orifices 22 of the flat ends 21 of the elongate body member 20, and may be engaged with washers 34 respectively for securing the elongate body member 20 and the covering member 30 between the links 29. The fasteners 33 may further be engaged with the flaps 31 of the covering member 30 and/or the cushioning member 27 for further solidly securing the covering member 30 and the cushioning member 27 together. Two further anchor straps 37 each includes a curved member 38 engaged over the links 29 for securing the handle to the suitcase or the like.

The resilient cushioning member 27 may be secured onto the elongate body member 20 with adhesive materials or the like. As shown in FIG. 3, a wrapping member 40, such as a wire or a tape 40 may be engaged around or may wrap the cushioning member 27 onto the elongate body member 20 before engaging the cushioning member 27 onto the elongate body member 20 into the covering member 30. As shown in FIG. 4, the cushioning member 27 may also simply be engaged onto or wrapped around the elongate body member 20 and then engaged into the covering member 30, without being secured to the elongate body member 20 with the adhesive materials.

In operation, as shown in FIGS. 3 and 4, the users may grasp the handle with a suitable or increased comfortableness due to the cushioning member 27 that is engaged within or between the elongate body member 20 and the covering member 30, and that will not be disengaged from the covering member 30.

Accordingly, the handle in accordance with the present invention includes a structure for allowing the user to grasp with more comfortableness.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A handle comprising:

an elongate body member including two ends, a covering member engaged around said elongate body member, a cushioning member engaged around said elongate body member and engaged between said elongate body member and said covering member for providing a comfortable grasping structure two links, and two anchor straps engaged on said ends of said elongate body member and coupled to said links respectively.

2. The handle according to claim 1, wherein said covering member includes two end ears folded relative to said covering member and secured to said covering member.

3. The handle according to claim 2 further comprising means for fastening said end ears and said covering member and said ends of said elongate body member together.

4. The handle according to claim 3, wherein said fastening means includes two fasteners engaged through said end ears of said covering member and engaged through said cushioning member for solidly securing said covering member and said cushioning member together.

5. The handle according to claim 1, wherein said covering member includes two end ears folded relative to said covering member and engaged over said anchor straps, and secured to said covering member.

6. The handle according to claim 1 further comprising means for fastening said end ears and said covering member and said anchor straps and said ends of said elongate body member together.

7. The handle according to claim 6, wherein said fastening means includes two fasteners engaged through said end ears and said covering member and engaged through said anchor straps and engaged through said ends of said elongate body member.

8. The handle according to claim 1, wherein said anchor straps each includes a curved member engaged over said links respectively, and two panels engaged on said ends of said elongate body member.

9. The handle according to claim 1, wherein said covering member includes two flaps engaged around said cushioning member and said elongate body member.

10. The handle according to claim 1 further comprising a wrapping member engaged around said cushioning member before said covering member is engaged around said cushioning member.

11. The handle according to claim 1, wherein said elongate body member includes at least one ridge extended therefrom for forming a spatial configuration.

* * * * *